US006519980B1

(12) United States Patent
Walker

(10) Patent No.: US 6,519,980 B1
(45) Date of Patent: Feb. 18, 2003

(54) HOSIERY DEWRINKLING SYSTEM AND METHOD FOR CIRCULAR KNITTING MACHINES

(75) Inventor: Ronnie Walker, Aiken, SC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/115,743

(22) Filed: Apr. 3, 2002

(51) Int. Cl.[7] ..... D04B 35/00
(52) U.S. Cl. ..... 66/147
(58) Field of Search ..... 66/147, 148, 149 R, 66/150, 149 S, 19, 28, 31

(56) References Cited

U.S. PATENT DOCUMENTS

| | | | | |
|---|---|---|---|---|
| 3,267,698 | A | 8/1966 | Poteat | |
| 3,430,464 | A | 3/1969 | Mazzi | |
| 4,287,729 | A | 9/1981 | Manini née Gallichi | |
| 4,339,932 | A | 7/1982 | Lonati | |
| 4,454,729 | A | 6/1984 | Lonati | |
| 4,773,237 | A | 9/1988 | Lonati | |
| 4,945,734 | A | 8/1990 | Maruyama | |
| 5,052,196 | A | 10/1991 | Turini | |
| 5,127,558 | A | 7/1992 | Paolo | |
| 5,133,196 | A | 7/1992 | Tibbals, Jr. | |
| 5,157,946 | A | 10/1992 | Egea et al. | |
| 5,167,134 | A | 12/1992 | Fučik et al. | |
| 5,170,645 | A | 12/1992 | Lonati et al. | |
| 5,231,856 | A | 8/1993 | Lonati et al. | |
| 5,802,877 | A | 9/1998 | Yates et al. | |
| 6,044,668 | A | 4/2000 | Conti | |
| 6,092,395 | A | 7/2000 | Revill | |
| 6,158,252 | A | 12/2000 | Conti | |
| 6,205,821 | B1 | 3/2001 | Sangiacomo | |
| 6,282,925 | B1 * | 9/2001 | Ando | 66/148 |
| 6,324,873 | B1 | 12/2001 | Sangiacomo | |
| 6,381,991 | B2 * | 5/2002 | Ando | 66/148 |

* cited by examiner

*Primary Examiner*—Danny Worrell
(74) *Attorney, Agent, or Firm*—Kilpatrick Stockton LLP

(57) ABSTRACT

A programmable system and method for dewrinkling, or removing wrinkles from, a hosiery article in a circular knitting machine comprise a dial head movable between a down position and an up position, a means for moving the dial head downward and upward, and a dial head locking mechanism for locking and unlocking the dial head. When the dial head is unlocked and moved to the up position, wrinkles are removed from the hosiery article. A dewrinkling system and method of the present invention are particularly well-suited for removing wrinkles from hosiery articles having thick cuffs, such as quarter socks.

74 Claims, 6 Drawing Sheets

HOSIERY DEWRINKLING SYSTEM AND METHOD FOR CIRCULAR KNITTING MACHINES

FIELD OF THE INVENTION

The present invention relates to circular knitting machines for manufacturing hosiery articles, and in particular to a system and a method for manufacturing hosiery articles that removes wrinkles in the hosiery cuff.

BACKGROUND

Conventional circular knitting machines are electronically programmable to control the relative movements of a knitting cylinder, needles, dial jacks, sinkers, stitch cams, thread guides, and other components and elements of the machine in order to operate the knitting process and to obtain different kinds of knitting patterns. Needles, sinkers, and jacks are arranged at equal distances around the circumference of a knitting cylinder. The cylinder moves vertically. A dial jack is a steel blade that moves horizontally across the cylinder and controls the movement of knitting needles. A dial is a circular plate with radially positioned slots to hold a set of knitting needles. A dial is connected to a dial head and is aligned over the top of a knitting cylinder. When a dial jack moves across a knitting cylinder, it holds a course of thread in place. Dial jacks are connected to a dial such that when a dial moves up or down, the dial jacks move correspondingly. If a dial jack is holding a course of thread in an article being knitted and the dial is moved, the article being knitted moves in correspondence with the movement of the dial.

Tubular hosiery articles, for example socks, are typically knit on circular knitting machines. When knitting is complete and socks come off a knitting machine, the cuff, or welt, is generally wrinkled, or "bunched." For socks with larger cuffs, such as quarter socks, wrinkling is a particular problem. After knitting is complete, the tubular hosiery blanks are transported away from the knitting machine, for example to another machine where the toe portion is closed by sewing a toe seam. Because toe seams are often sewn on the inside of a sock, socks are turned inside out to position them for sewing an internal seam.

In conventional manufacturing processes, socks are transported directly from a knitting machine to a sewing machine or station for toe closure. At the sewing station, socks can be manually turned inside out and the "bunched" cuff straightened by hand in the process. In other processes, socks are transported from a knitting machine to a sewing station by a pneumatic means. For example, in typical knitting of tubular hosiery blanks, a hosiery takedown device applies suction to a hosiery blank while the blank is being knit. When the knitting is finished, a vacuum is applied and pulls the blank away from the knitting elements and transports it to another location. In such a pneumatic transportation system, the socks can be turned inside out, or reversed, through pneumatic tensioning in the annular space between an outer tube and an inner tube. Pneumatic tensioning and reversing processes can provide incidental straightening of a small portion of wrinkles in a cuff. However, the majority of wrinkles remain in a sock having a thick cuff, such as a quarter sock, even after application of pneumatic tension in conventional knitting machines.

These conventional approaches to de-wrinkling cuffs in socks have disadvantages and are particularly unsuitable in some manufacturing processes. A disadvantage of conventional pneumatic tensioning devices and processes is that additional machinery and complex operations are involved. In addition, certain intervening steps in newer manufacturing practices and procedures cause de-wrinkling at the toe sewing stage to be ineffective. In particular, knitted socks are often shipped to a remote location for finishing. In such a situation, socks may be transported directly from a knitting machine to a bleaching vat and then dried at high temperatures in an industrial drier. With no de-wrinkling procedure prior to bleaching and drying, cuff wrinkles are heat-set by the high drying temperatures.

Another step that compounds wrinkle-setting problems involves packaging socks for transportation to a remote location for finishing operations. To conserve shipping space and costs, socks transported to a finishing plant for processing steps such as sewing are often highly compacted into a container or bail using a hydraulic press. Textile materials that have undergone such high-pressure compaction can be uncompacted with techniques such as washing. However, unstraightened cuff wrinkles that are subsequently highly compacted can become permanently set. Various textile fibers that are wrinkled and then compacted can be damaged beyond usability.

Socks that have a cuff, or turned welt, that is full-length are more susceptible to damage from wrinkles that are heat-set and/or compacted due to a larger amount of material in the cuffs. For example, "quarter socks" having a full-length cuff exhibit an unacceptably high rate of damage due to wrinkles set by heat-drying and compaction processes. A quarter sock typically has double the number of courses in the top cuff portion as a crew sock, for example. While a typical crew sock may have 30 courses of thread, a quarter sock may have 60 courses. The mass of such a double-thickness cuff causes the cuff to bunch and not feed down the knitting cylinder dial without intervention. Bunching of a sock cuff inside the knitting cylinder creates wrinkles in the cuff.

Thus, there is a need to provide a system and method for automatically removing the majority of wrinkles in hosiery, particularly in hosiery having large cuffs, during manufacturing on a circular knitting machine. There is also a need for a system and method for automatically removing the majority of wrinkles in hosiery cuffs that facilitates removal of the hosiery article from a circular knitting machine. There is also a need for a system and method for automatically removing the majority of wrinkles in hosiery in a circular knitting machine that is simple to construct and operate.

SUMMARY OF THE INVENTION

The present invention provides a programmable system and method for dewrinkling, or removing wrinkles from, a hosiery article in a circular knitting machine. An embodiment of the present invention comprises a dial head movable between a down position and an up position, a means for moving the dial head downward and upward, and a dial head locking mechanism for locking and unlocking the dial head. When the dial head is unlocked and moved to the up position, wrinkles are removed from the hosiery article. Such embodiments can include a means for applying suction to the hosiery article. In embodiments, the means for moving the dial head downward and upward comprises a vertical air piston. In other embodiments, the dial head locking mechanism comprises a horizontal air piston.

A system and method of the present invention include a means for moving the dial head downward and upward and a dial head locking mechanism that are each programmable for automatic actuation at predetermined times during a knitting cycle. In embodiments, the means for moving the dial head downward and upward is programmed to move the dial head to the up position immediately after the top course of the cuff is knit.

In the present invention, the dial head is moved up a predetermined distance from the dial head down position. In embodiments, the predetermined distance the dial head is moved up from the dial head down position comprises the range of one-fourth inch to one inch. In preferred embodiments, the predetermined distance the dial head is moved up from the dial head down position is three-fourths inch.

A dewrinkling system and method of the present invention provides for removal of wrinkles from an entire hosiery article. Embodiments of the present invention are particularly well-suited for removing wrinkles from hosiery articles having thick cuffs, such as quarter socks with double-thickness cuffs.

In embodiments of the present invention, each air piston is connected to a source of compressed air by a separate air tube, an electrovalve for each air piston is connected to the source of compressed air, and each electrovalve is programmable to turn on and off a flow of compressed air to the respective air piston at predetermined times during a knitting cycle. Embodiments can include an air flow adjustment valve connected to each air tube for buffering the flow of compressed into the air piston connected to the air tube.

An embodiment of a method for dewrinkling a hosiery article in a circular knitting machine comprises unlocking the dial head and moving the dial head to the up position to stretch the hosiery article, wherein wrinkles are removed from the hosiery article. Such a method can include applying suction to the hosiery article.

Embodiments of a method comprise programming a circular knitting machine to knit a predetermined number of courses of a hosiery article by rotating the dial a corresponding number of revolutions of the knitting cylinder at particular times during the knitting process. For example, a knitting machine can be programmed to knit a predetermined number of courses of a hosiery article before and after disengaging the dial shaft latch from the dial shaft, after moving the dial head to the up position, and after moving the dial head to the down position. Such a predetermined number of cylinder revolutions allows time for the physical operations of the electrovalves, air pistons, and movement of the dial shaft latch and dial head to occur before proceeding to the next step in the dewrinkling process.

Features of a hosiery dewrinkling system and method of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A hosiery dewrinkling system and method of the present invention provides numerous advantages over prior approaches to removing wrinkles in hosiery articles. For example, the present invention advantageously provides a system and method for dewrinkling hosiery that is efficient and effective. The present invention can be incorporated into a conventional knitting machine, providing the benefit of removing wrinkles in a hosiery article without transporting the articles to another work station. Another advantage is the present invention can be programmed into a knitting machine to remove wrinkles from hosiery articles automatically. As such, the present invention provides a system and method for dewrinkling hosiery articles that is integrated into normal knitting processes without slowing production time. By avoiding manual straightening of wrinkles in hosiery cuffs, production times can be enhanced.

Another advantage is that the present invention provides a system and method for dewrinkling hosiery articles that eliminates virtually all of the wrinkles in a sock, including socks having a thick cuff or welt.

Another advantage is that the present invention provides a system and method for removing wrinkles during the knitting process, prior to drying articles, and heat-setting wrinkles therein, and before articles are compacted.

Another advantage is that by removing wrinkles during the knitting process, the present invention facilitates removal of a thick-cuffed hosiery article from a knitting cylinder.

Still another advantage is that the present invention provides a dewrinkling device and system that has a simple construction and is uncomplicated in operation and servicing. A system and method for dewrinkling hosiery articles of the present invention can advantageously be used on different types of knitting machines.

Yet another advantage is that the present invention is reliable in operation due to a smooth moving design including air flow adjustment valves, a horizontal air piston spring, and electronic control of air flow. These features decrease the wear and tear of the dewrinkling system components and prolong the service life of the system and the knitting machines used thereon.

As will be realized by those of skill in the art, many different embodiments of a hosiery dewrinkling system and method according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Figure 1:
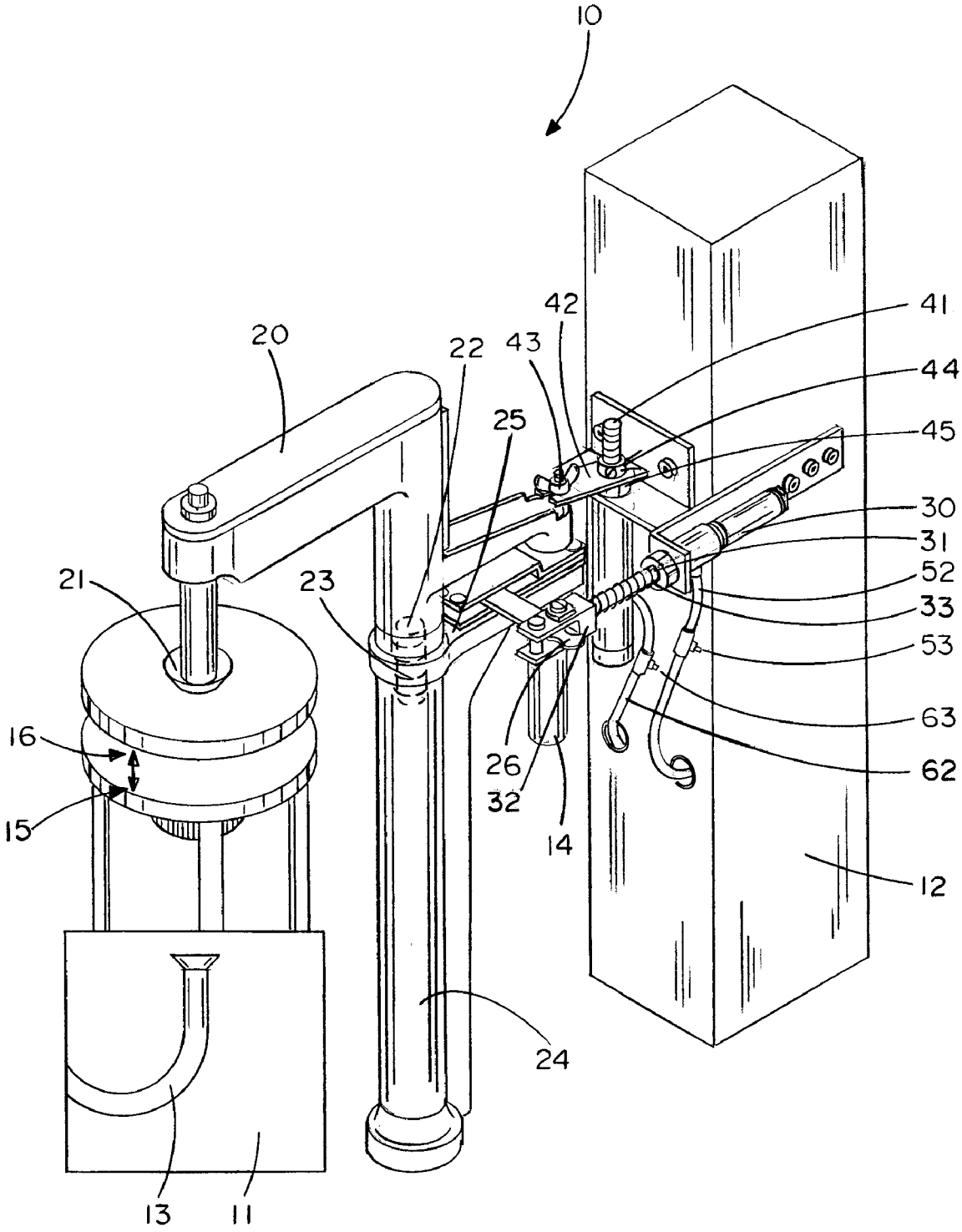
FIG. 1 is a view of a system for dewrinkling hosiery articles in a circular knitting machine in an embodiment of the present invention.
Figure 2:
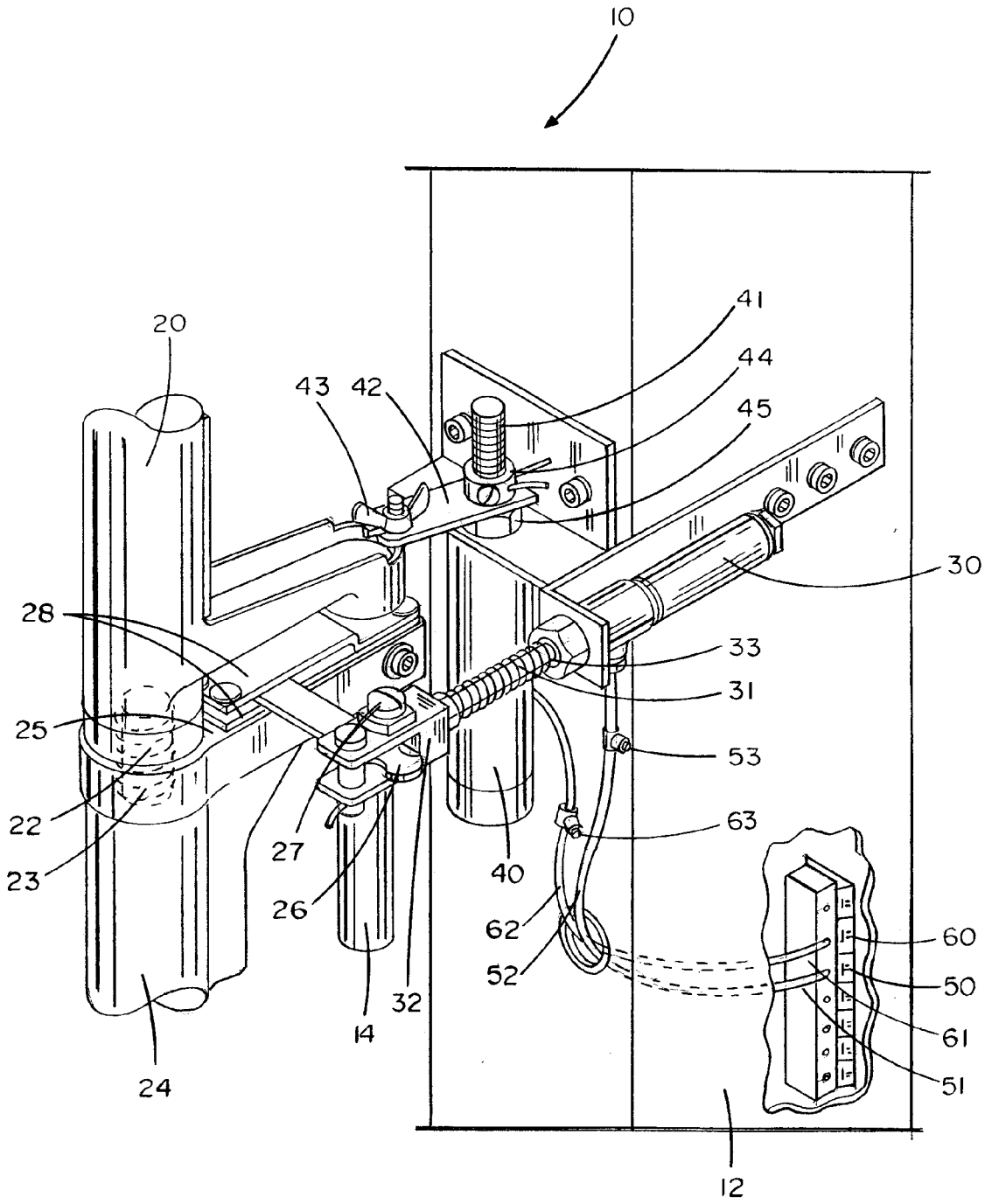
FIG. 2 is a view of the system for dewrinkling hosiery articles in a circular knitting machine in FIG. 1, showing a horizontal air piston and a vertical air piston in an embodiment of the present invention.

FIGS. 1–6 show various aspects of embodiments of the present invention. One embodiment comprises a programmable system and method for dewrinkling a hosiery article in a circular knitting machine, comprising a dial head connected to a dial shaft and movable between a down position and an up position, a means for moving the dial head downward and upward, a dial shaft latch engagable with the dial shaft, a dial shaft engagement mechanism for engaging and disengaging the dial shaft latch with the dial shaft, and a means for applying suction to the hosiery article. When suction is applied to the hosiery article, the dial shaft engagement mechanism disengages the dial shaft latch from the dial shaft, and the means for moving the dial head moves the dial head to the up position to stretch the hosiery article, wrinkles are removed from the hosiery article. FIGS. 1 and 2 show one such embodiment.

Referring to the embodiment in FIGS. 1 and 2, circular knitting machine 10 includes a front cabinet 11 and a back cabinet 12 for housing and supporting operative components of the circular knitting machine 10. Suction is applied from a suction tube 13 housed in front cabinet 11 and connected to a vacuum, or suction, source. The suction tube 13 is aligned directly below a hosiery article and a knitting cylinder (not shown), which are coaxial with dial 21. Suction helps stretch the hosiery article so that wrinkles are more effectively removed when the dial 21 and hosiery article are moved up from the normal down knitting position 15. The vacuum source for applying suction can be the same source as that used for suction in a pneumatic transportation system for transporting the knitted hosiery article away from the knitting cylinder.

Circular knitting machine 10 comprises a dial head 20 connected to a dial shaft 22 and movable between the normal down knitting position 15 and an up position 16. A means for moving the dial head upward comprises a dial shaft spring 23, which surrounds the dial shaft 22 and is biased for moving the dial head 20 to the up position 16. The dial shaft 22 is mounted in a dial shaft housing 24. A dial head shelf 25 extends substantially perpendicularly from the dial shaft housing 24 at a level for supporting the dial head 20 in the down position 15. A dial shaft latch 26 is attached at one end to a pivot screw 27, which is anchored to a stationery pivot point (not shown) on one side of the dial head shelf 25. A latch slide 28 having two spaced apart members is mounted to the top of the dial head shelf 25 and substantially perpendicularly to the dial shaft latch 26, such that the dial shaft latch 26 is slidably positioned between the two spaced apart members of the latch slide 28.

A horizontal air piston 30 is mounted on back cabinet 12 and is operably connected to the dial shaft latch 26 for moving the dial shaft latch 26 out of engagement with the dial shaft 22. The horizontal air piston 30 has a horizontal air piston rod 31 slidably connected in coaxial relation to the horizontal air piston 30. The horizontal air piston rod 31 is connected at the end opposite the horizontal air piston 30 to a dial shaft latch coupler 32. The end of the dial shaft latch 26 opposite the end attached to the pivot screw 27 is attached in pivotable relationship with the dial shaft latch coupler 32. In such configuration, the dial shaft latch 26 is pivotable about the pivot screw 27 at the stationery pivot point and along the latch slide 28.

When the horizontal air piston 30 is activated, the horizontal air piston rod 31 retracts, or pulls, the dial shaft latch 26 out of engagement with the dial shaft 22 to unlock the dial head 20, compressing the horizontal air piston spring 33 in the process. As the horizontal air piston 30 pulls the dial shaft latch 26 toward the horizontal air piston 30, the dial shaft latch 26 pivots about the stationery pivot point on the side of the dial head shelf 25, disengaging a dial shaft locking pin (not shown) in the dial head shelf 25. As a result, the dial shaft latch 26 disengages the dial shaft 22, allowing the dial head 20 to move upward. In conventional operations, a locked dial shaft may move up from the dial head shelf less than one-fourth inch. Disengaging, or unlocking, the dial shaft 22 allows the dial head 20 to move upward more than the less than one-fourth inch movement allowed when the dial head 20 is engaged, or locked.

The horizontal air piston spring 33 is coiled around the horizontal air piston rod 31 between the horizontal air piston 30 and the dial shaft latch coupler 32, and is biased to move the horizontal air piston rod 31 and dial shaft latch 26 away from the horizontal air piston 30 and into engagement with the dial shaft 22. In this embodiment, a dial shaft engagement mechanism comprises the horizontal air piston 30, horizontal air piston rod 31, dial latch coupler 32, dial latch 26, pivot screw 27, latch slide 28, and horizontal air piston spring 33, which cooperate to engage and disengage the dial shaft latch 26 with the dial shaft 22.

Figure 3:
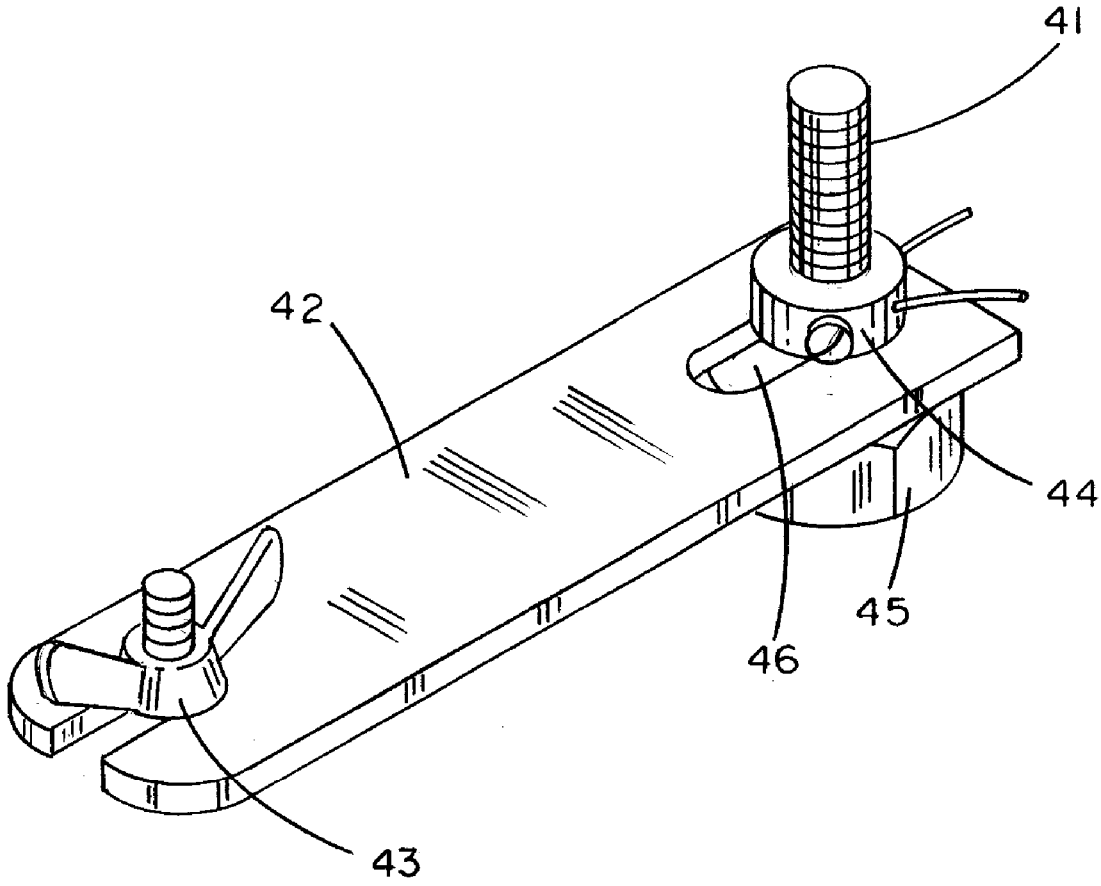
FIG. 3 is close-up perspective view of the piston connecting member and fasteners shown in FIGS. 1 and 2, showing a slot through which the vertical piston rod extends in an embodiment of the present invention.
Figure 4:
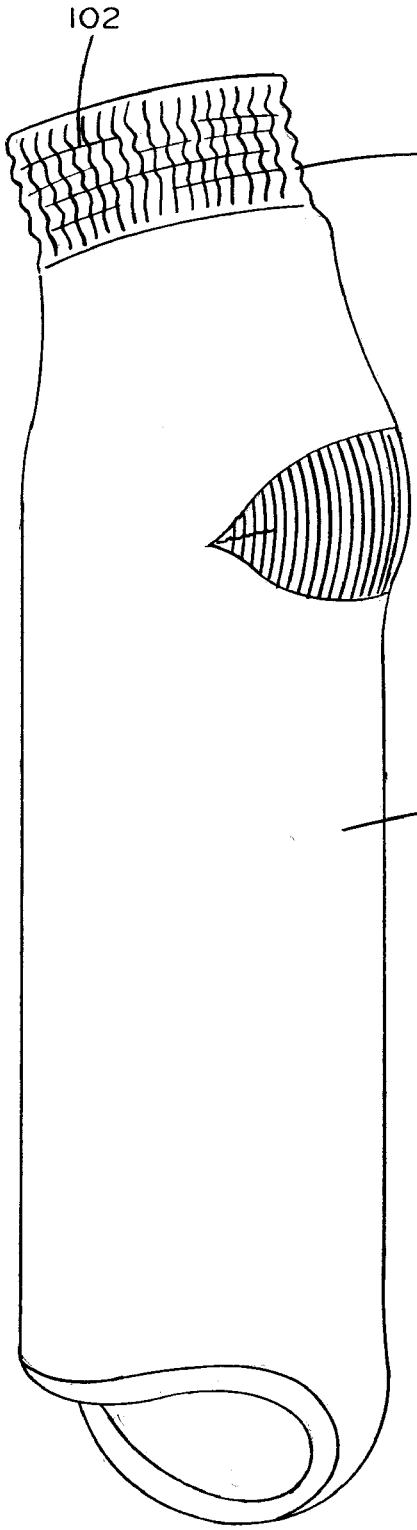
FIG. 4 is a view of a sock showing a wrinkled cuff which can be overcome by embodiments of the present invention.

As shown in FIGS. 1 and 2, a means for moving the dial head 20 downward comprises a vertical air piston 40 mounted on back cabinet 12. The vertical air piston 40 has a vertical air piston rod 41 slidably connected in coaxial relation with the vertical air piston 40. The dial head 20 is connected to the vertical air piston rod 41 with a piston connecting member 42. As shown in the embodiment in FIG. 2, the piston connecting member 42 is fastened to the dial head 20 with a nut 43 above alignment shaft 14. The piston connecting member 42 has a slot 46, as shown in FIG. 3, formed in one end. The piston connecting member 42 is slidably connected through the slot 46 to the vertical air piston rod 41 on the top of the vertical air piston 40 between a top nut 44 and a bottom adjustment nut 45. The piston connecting member 42 can be fastened to the dial head 20 and to the vertical air piston rod 41 in ways other than shown in the embodiments in FIGS. 1 and 2. For example, piston connecting rod 42 could be fastened to dial head 20 by welding or by being integrally manufactured with the dial head 20. Piston connecting member 42 could be fastened to the vertical air piston rod 41 with cotter pins, for example.

The distance that the dial head 20 is moved upward from the dial head shelf 25, and correspondingly the distance the dial 21 is moved upward from the knitting cylinder, is determined by the distance the piston connecting member 42 is moved upward by the dial shaft spring 23. The distance the dial head 20 is moved upward from the dial head shelf 25 is the same distance of movement of the piston connecting member 42 above the top of the vertical air piston 40. This distance of movement is adjusted by a means for adjusting the distance the piston connecting member 42 can move up along the vertical air piston rod 41. For example, the distance the piston connecting member 42 can move up in the embodiment shown in FIG. 2 is the distance between the top nut 44 and the bottom adjustment nut 45 on the vertical air piston rod 41. Moving the bottom adjustment nut 45 up or down on the vertical air piston rod 41 adjusts and sets the distance between the top nut 44 and the bottom adjustment nut 45. Adjusting the bottom adjustment nut 45 farther down the vertical air piston rod 41 allows the piston connecting member 42 and the dial head 20 to move a greater distance upward when the vertical air piston 40 is deactivated. As such, the bottom adjustment nut 45 allows an operator to adjust the distance upward that the piston connecting member 42 and the dial head 20 can move.

In conventional circular knitting operations, with the dial shaft latch 26 in engagement with the dial shaft 22, the dial head 20 can move up no more than one fourth inch from the down knitting position 15. In embodiments of a dewrinkling system of the present invention, a hosiery article attached to the dial 21 is moved up from the normal down knitting position 15 the same distance the dial head 20 moves up from the dial head shelf 25. For example, in the embodiments shown in FIGS. 1 and 2, the bottom adjustment nut 45 is set to allow the piston connecting bar 42 and the dial head 20 to move upward from the dial head shelf 25 between one-fourth inch and one inch. Correspondingly, the dial 21 and attached hosiery article are set to move up between one-fourth inch and one inch from the down knitting position 15 to the up position 16. Preferably, the bottom adjustment nut 45 is set to allow the piston connecting bar 42 and the dial head 20 to move upward from the dial head shelf 25, and the dial 21 and attached hosiery article to move up from the down knitting position 15 to the up position 16, approximately three-fourths inch.

In embodiments, the vertical air piston 40 is programmed to maintain pressurization by a flow of compressed air into the vertical air piston 40 from the beginning of the knitting cycle. When air pressure is applied to the vertical air piston 40, the dial head 20 and dial 21 are maintained in the down knitting position 15. After the dial shaft latch 26 is disengaged from the dial shaft 22, thereby unlocking the dial shaft 22, air pressure to the vertical air piston 40 is turned off.

Figure 5:
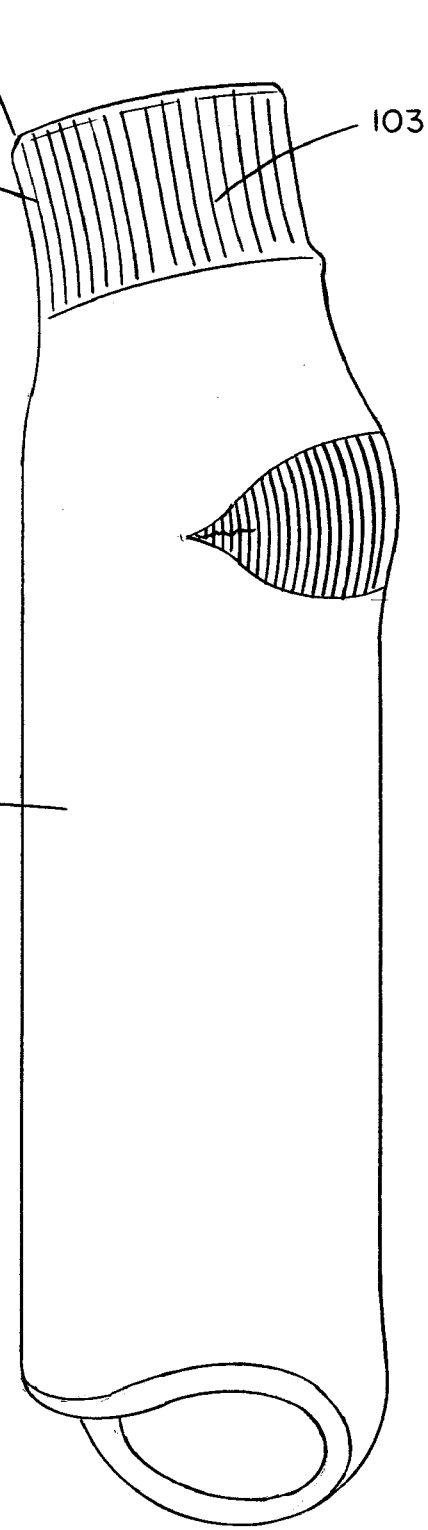
FIG. 5 is a view of a sock showing a dewrinkled cuff in an embodiment of the present invention.

When air pressure to the vertical air piston 40 is turned off, the spring force of the dial shaft spring 23 causes the dial head 20 and dial 21 to move upward. The dial head 20 and dial 21 can be moved up from the down knitting position 15 and back to the original down knitting position 15 at any desired point during the knitting cycle. Preferably, the dial head 20 and dial 21 are moved upward at the midpoint of courses to be knit for the hosiery welt, or cuff. By so doing, a dial jack, or trick, holds the course that will be at the top 104 of the cuff 101, as shown in FIG. 5. Moving the hosiery article 100 upward by holding the top 104 of the cuff 101 will stretch the entire cuff 101 by its full length. As a result, cuff 101 of hosiery article 100, as shown wrinkled 102 in FIG. 4, will be stretched to an unwrinkled, or dewrinkled, condition 103, as shown in FIG. 5.

Moving dial head 20, dial 21, and a hosiery article in the process of being knit upward in such manner stretches the hosiery article in an upward direction. Stretching the hosiery article in this manner while in place around the knitting cylinder in conjunction with suction applied from below the hosiery article effectively removes wrinkles from the hosiery article, particularly in the cuff portion. To provide optimal stretch of the hosiery article, the dial head 20, dial 21, and hosiery article preferably move up three-fourths inch from the down knitting position 15.

Moving the dial head up too high could stretch the hosiery article out of its desired shape and/or break the yarn.

In the present invention, embodiments of a dewrinkling system include programming to activate disengagement of the dial shaft latch 26 from the dial shaft 22, movement of the dial head 20 and hosiery article upward, movement of the dial head 20 and hosiery article downward, and engagement of the dial shaft latch 26 with the dial shaft 22 at predetermined times during the course of knitting a hosiery article.

In embodiments of the present invention, the horizontal air piston 30 and the vertical air piston 40 are each connected to an activation source. For example, as shown in the embodiment in FIG. 2, the horizontal air piston 30 is connected to a source of compressed air 51 by air tube 52, and the vertical air piston 40 is connected to a source of compressed air 61 by air tube 62. Electronically-controlled valves, referred to as "electrovalves" 50, 60, located in the back cabinet 12, are connected to the source of compressed air 51, 61 for each respective air piston 30, 40. Each electrovalve 50, 60 is programmable to turn on and off a flow of compressed air to the respective air piston 30, 40 at predetermined times during a knitting cycle.

An air flow adjustment valve 53 is connected to the air tube 52 for regulating the flow of compressed air into the horizontal air piston 30 in a smooth, controlled fashion. Such a regulated flow of compressed air into the horizontal air piston 30 buffers the movement of the dial shaft latch 26. In addition, the horizontal air piston spring 33, which is biased to move the horizontal air piston rod 31 and the dial shaft latch 26 away from the horizontal air piston 30, provides resistance to retraction of the horizontal air piston rod 31 and allows the horizontal air piston rod 31 to move back into the horizontal air piston 30 more gradually. As such, the horizontal air piston spring 33 cushions movement of the dial shaft latch 26. This provides for ease of movement of the dial shaft latch 26 and minimizes wear and tear on the knitting machine 36 components.

In embodiments, after the hosiery article being knit is moved upward and stretched to remove wrinkles, electrovalve 60 is programmed to activate the vertical air piston 40 by allowing a flow of compressed air to the vertical air piston 40. The vertical air piston 40 pulls the dial head 20 down to its original down knitting position 20. An air flow adjustment valve 63 is connected to the air tube 62 for regulating the flow of compressed air into the vertical air piston 40 in a smooth, controlled fashion. Such a regulated flow of compressed air into the vertical air piston 40 buffers the downward movement of the dial head 20 to its original down knitting position 15 resting in contact with the dial shelf 25. This provides for ease of movement of the dial head 20 and thus preserves the integrity of attached components such as threads for knitting and minimizes wear and tear on the knitting machine.

Electrovalve 50 is programmed to then deactivate the horizontal air piston 30 by cutting off the flow of compressed air to the horizontal air piston 30. The horizontal air piston spring 33, which is biased to move the horizontal air piston rod 31 and dial shaft latch 26 away from the horizontal air piston 30, pushes the horizontal air piston rod 31 and the dial shaft latch 26 toward the dial shaft 22. The dial shaft latch 26 pivots about the stationery pivot point (not shown) on the side of the dial head shelf 25 between members of the latch slide 28, re-engaging the dial To shaft locking pin (not shown) in the dial head shelf 25. The dial shaft latch 26 is thus moved back into engagement with the dial shaft 22 and locks the dial head 20 in its original down knitting position 15.

In embodiments, the means for moving the dial shaft latch 26 horizontally and the means for moving the dial head 20 vertically comprise mechanisms other than pistons driven by compressed air. For example, electromagnetic mechanisms for moving rods attached to the dial shaft latch 26 and to the dial head 20 could be used. Alternatively, means for moving the dial shaft latch 26 and means for moving the dial head 20 could comprise a source of vacuum to power such movement or could be fluid-actuated, such as with a hydraulic system.

Embodiments of the present invention include a method for dewrinkling a hosiery article in a circular knitting machine. For example, such a method can be carried out utilizing the circular knitting machine shown in FIGS. 1 and 2, in which a system for dewrinkling a hosiery article comprises a dial head 20 connected to a dial shaft 22 and movable between a down position 15 and an up position 16, a means for moving the dial head 20 downward and upward, a dial shaft latch 26 engagable with the dial shaft 22, a dial shaft engagement mechanism for engaging and disengaging the dial shaft latch 26 with the dial shaft 22, and a means for applying suction to the hosiery article, such as through the suction tube 13. A method of the present invention comprises applying suction to the hosiery article, disengaging the dial shaft latch 26 from the dial shaft 22, and moving the dial head 20 to the up position 16 to stretch the hosiery article, wherein wrinkles are removed from the hosiery article.

An embodiment of such a method comprises programming the means for moving the dial head 20 downward and upward and the dial shaft engagement mechanism for automatic actuation at predetermined times during a knitting cycle. Embodiments include programming the means for moving the dial head 20 downward and upward to move the dial head 20 to the up position 16 immediately after the top 104 course of a hosiery cuff 101 (FIG. 5) is knit.

Embodiments of a method comprise moving the dial head 20 a predetermined distance from the dial head down position 15 to the dial head up position 16. In embodiments, the predetermined distance of the dial head up position 16 from the dial head down position 15 comprises the range of one-fourth inch to one inch. In preferred embodiments, the predetermined distance of the dial head up position 16 from the dial head down position 15 is three-fourths inch.

In methods of the present invention, the means for moving the dial head 20 downward and upward includes a vertical air piston 40 for moving the dial head 20 to the down position 15. The means for moving the dial head 20 downward and upward can further comprise a dial shaft spring 23 surrounding the dial shaft 22 for moving the dial head 20 to the up position 16.

The vertical air piston 40 in embodiments of methods can comprise a movable vertical air piston rod 41 and a piston connecting member 42 fastened to the dial head 20 and slidably connected to the vertical air piston rod 41. Such a method further comprises moving the vertical air piston 40 downward a certain distance, wherein the dial head 20 moves downward a corresponding distance. Such methods can include a means for adjusting a range of movement of the piston connecting member 42 in relation to the vertical air piston rod 41. Such a means for adjusting a range of movement of the piston connecting member 42 in relation to the vertical air piston rod 41 comprises a fastener fixed to the vertical piston rod 41 above the piston connecting member 42 and an adjustment fastener adjustably fixed to the vertical piston rod 41 below the piston connecting member 42.

The dial shaft engagement mechanism in embodiments of methods comprises a horizontal air piston 30 operably connected to the dial shaft latch 26 for moving the dial shaft latch 26 out of engagement with the dial shaft 22. In such methods, the horizontal air piston 30 can have a movable horizontal air piston rod 31 connected to the dial shaft latch 26 and a horizontal air piston spring 33 surrounding the horizontal air piston rod 31. Such an embodiment further comprises moving the horizontal air piston spring 33 away from the horizontal air piston 30 to move the dial shaft latch 26 into engagement with the dial shaft 22.

In embodiments of methods, the dial shaft 22 is mounted in a dial shaft housing 24 having a dial head shelf 25 extending perpendicularly from the dial shaft housing 24 at a level for supporting the dial head 20 in the down position 15. The horizontal air piston rod 31 is positioned on one side of the dial head shelf 25, a pivot means 27 is attached to the side of the dial head shelf 25 opposite the horizontal air piston rod 31, and a latch slide 28 having two spaced apart members is mounted to the top of the dial head shelf 25. The dial shaft latch 26 is pivotably attached to the pivot means 27 and slidably positioned between the two spaced apart members of the latch slide 28. As the horizontal air piston 30 pulls the dial shaft latch 26 toward the horizontal air piston 30, the dial shaft latch 26 pivots via the pivot means 27 on the side of the dial head shelf 25 and between the two spaced apart members of the latch slide 28, disengaging a dial shaft locking pin (not shown) in the dial head shelf 25. As a result, the dial shaft latch 26 disengages the dial shaft 22, allowing the dial head 20 to move upward.

In embodiments, a horizontal air piston 30 and a vertical air piston 40 is each connected to a source of compressed air 51, 61 by a separate air tube 52, 62. An electrovalve 50, 60 is connected to the source of compressed air 51, 61 for each respective piston 30, 40. A method further comprises programming each electrovalve 50, 60 to turn on and off a flow of compressed air to the respective air piston 30, 40 at predetermined times during a knitting cycle. Such a method can further include air flow adjustment valves 53, 63 connected to the respective air tubes 52, 62 for buffering the flow of compressed into the air piston connected to the air tube.

In an embodiment of a method of the present invention for dewrinkling a hosiery article in a circular knitting machine, the hosiery article comprises a thick cuff. In particular embodiments, the hosiery article comprises a quarter sock.

An embodiment of a method of the present invention comprises programming a circular knitting machine to knit a predetermined number of courses of a hosiery article by rotating the dial a corresponding number of revolutions of the knitting cylinder before disengaging the dial shaft latch 26 from the dial shaft 22. These courses provide enough fabric in the cylinder so that moving the dial 21 upward and stretching the hosiery article in the beginning stages of being knit will not stretch the yarn to the breaking point. In preferred embodiments, the predetermined number of dial revolutions before disengaging the dial shaft latch from the dial shaft comprises 10 to 20 revolutions.

Embodiments of a method comprise programming a circular knitting machine to knit a predetermined number of courses of a hosiery article by rotating the dial 21 a corresponding number of revolutions of the knitting cylinder after disengaging the dial shaft latch 26 from the dial shaft 22. Such a predetermined number of cylinder revolutions after the point at which the horizontal air piston 30 is activated to disengage the dial shaft latch 26 from the dial shaft 22 allows time for the physical operations of the electrovalve 50, pressurization of the horizontal air piston 30, and movement of the dial shaft latch 26 to occur before proceeding to the next step in the dewrinkling process. In preferred embodiments, the predetermined number of dial revolutions after disengaging the dial shaft latch 26 from the dial shaft 22 comprises 2 to 10 revolutions.

Embodiments of a method comprise programming a circular knitting machine to knit a predetermined number of courses of a hosiery article by rotating the dial 21 a corresponding number of revolutions of the knitting cylinder after moving the dial head 20 to the up position 16. Such a predetermined number of cylinder revolutions after the point at which the vertical air piston 40 is de-pressurized and the dial head 20 is moved upward by the dial shaft spring 23 allows time for the physical operations of the electrovalve 60, de-pressurization of the vertical air piston 40, and movement of the dial head 20 to occur before proceeding to the next step in the dewrinkling process. In preferred embodiments, the predetermined number of dial revolutions after moving the dial head 20 to the up position 16 comprises 8 to 10 revolutions.

Embodiments of a method comprise programming a circular knitting machine to knit a predetermined number of courses of a hosiery article by rotating the dial 21 a corresponding number of revolutions of the knitting cylinder after moving the dial head 20 to the down position 15. Such a predetermined number of cylinder revolutions after the point at which the vertical air piston 40 is activated to move the dial head 20 back to its original down knitting position 15 allows time for the physical operations of the electrovalve 60, pressurization of the vertical air piston 40, and movement of the dial head 20 to occur before proceeding to the next step in the dewrinkling process. In preferred embodiments, the predetermined number of dial revolutions after moving the dial head 20 to the down position 15 comprises 2 to 4 revolutions. Providing for a small number of cylinder revolutions between steps in the dewrinkling process also provides a margin for minor slowing of such physical operations that may occur between maintenance servicings of the knitting machine.

In embodiments of methods of the present invention, the knitting cycle is then completed and the knitted hosiery article is removed from the knitting machine, such as with a pneumatic transportation system. Methods further comprise repeating each step as described herein as each successive hosiery article is being knit.

Figure 6A:
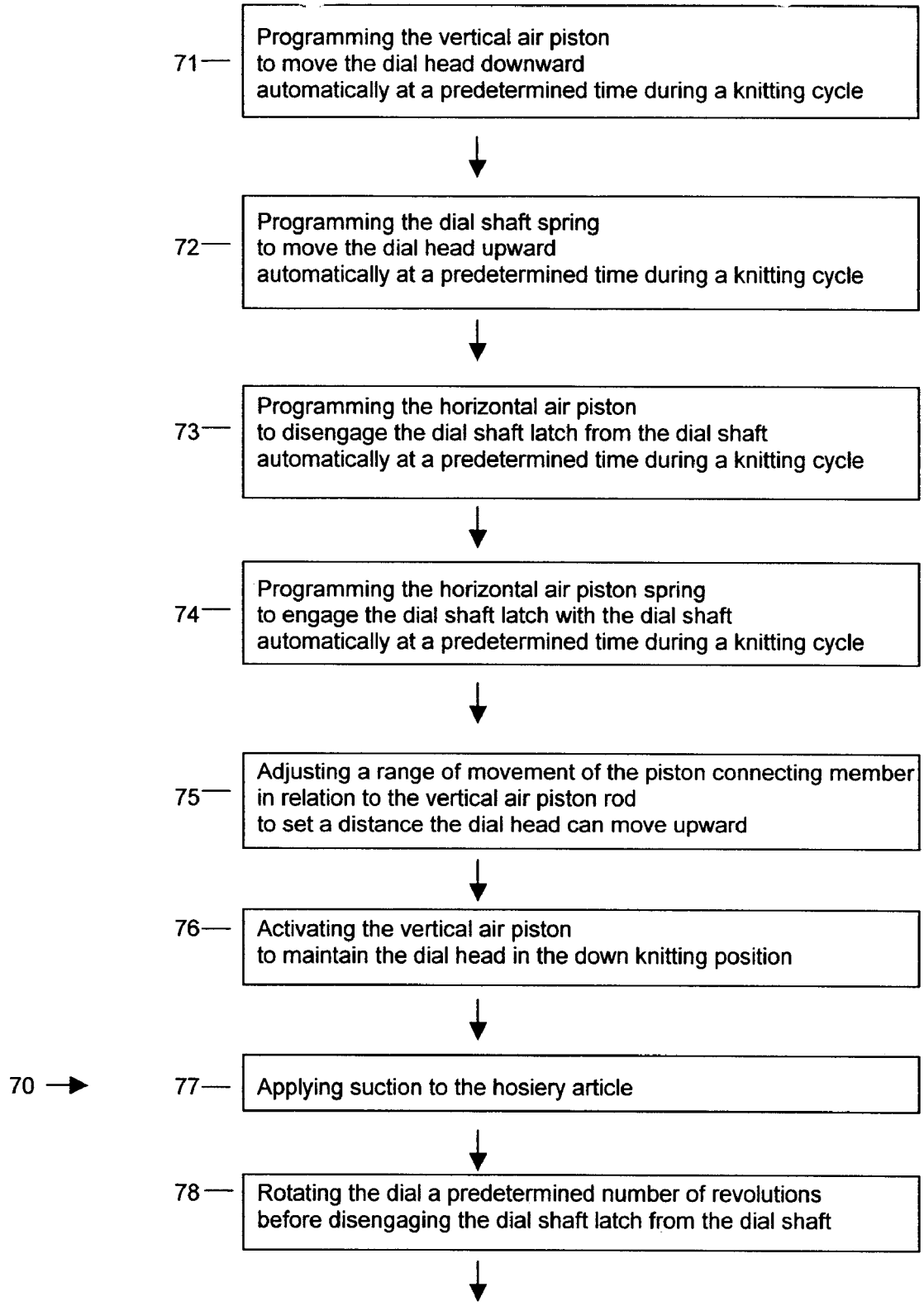
FIGS. 6A and 6B is a flow chart of a method in an embodiment of the present invention.
Figure 6B:
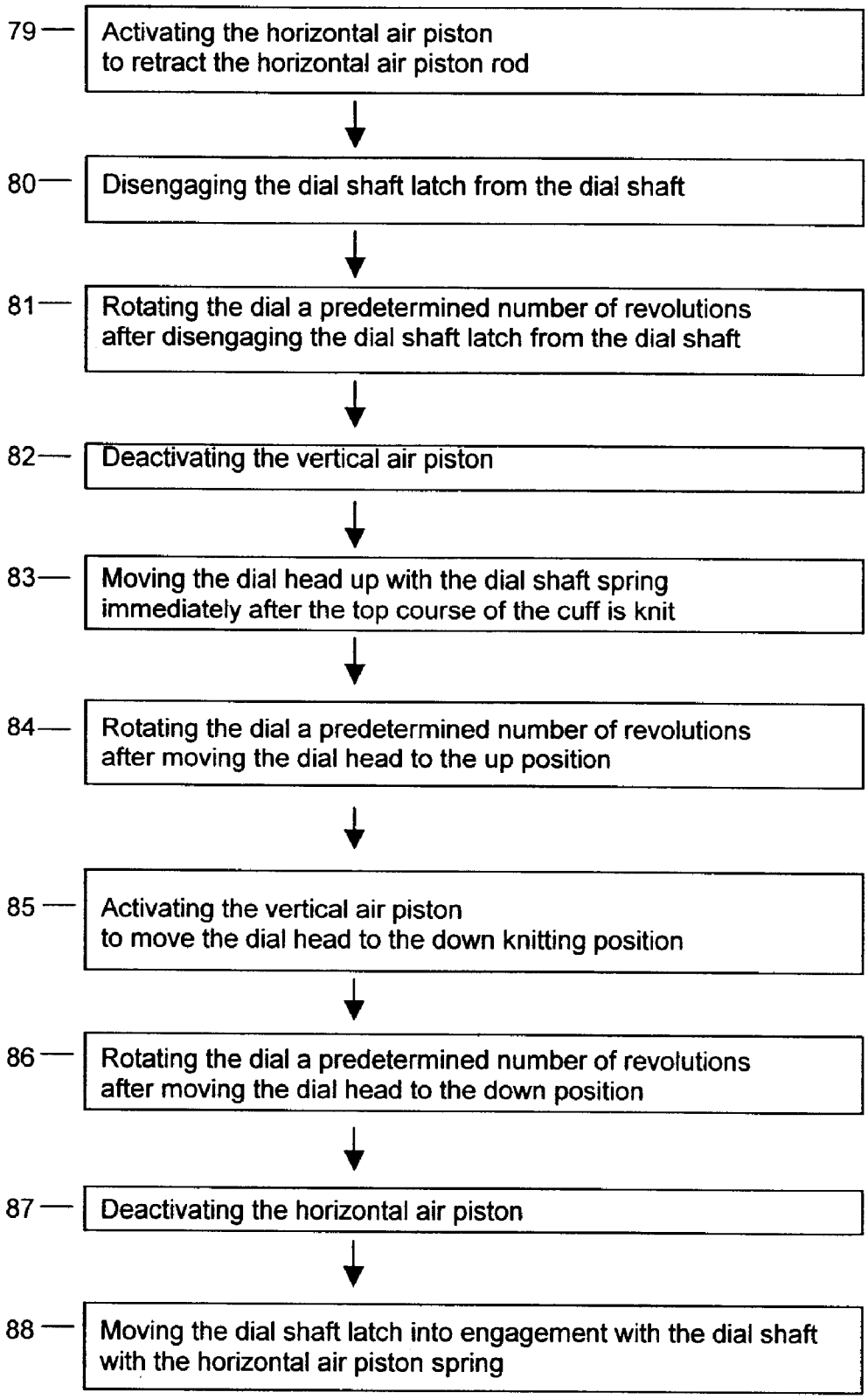

An embodiment of a method of the present invention is depicted in FIGS. 6A and 6B. Referring to FIGS. 6A and 6B, the method (70) for dewrinkling a hosiery article in a circular knitting machine comprises: (71) programming the vertical air piston 40 to move the dial head 20 downward automatically at a predetermined time during a knitting cycle; (72) programming the dial shaft spring 23 to move the dial head 20 upward automatically at a predetermined time during a knitting cycle; (73) programming the horizontal air piston 30 to disengage the dial shaft latch 26 from the dial shaft 22 automatically at a predetermined time during a knitting cycle; and (74) programming the horizontal air piston spring 33 to engage the dial shaft latch 26 with the dial shaft 22 automatically at a predetermined time during a knitting cycle. In addition, prior to beginning a knitting cycle, the method (70) includes (75) adjusting a range of movement of the piston connecting member 42 in relation to the vertical air piston rod 41 to set a predetermined distance the dial head 20 can move upward.

The method (70) further comprises (76) activating the vertical air piston 40 to maintain the dial head 20 in the down knitting position 15 and (77) applying suction to the hosiery article. Once the knitting cycle has begun, the next steps include (78) rotating the dial 21 a predetermined number of revolutions of the knitting cylinder before disengaging the dial shaft latch 26 from the dial shaft 22; (79) activating the horizontal air piston 30 to retract the horizontal air piston rod 31; and (80) disengaging the dial shaft latch 26 from the dial shaft 22.

After (81) rotating the dial 21 a predetermined number of revolutions of the knitting cylinder after disengaging the dial shaft latch 26 from the dial shaft 22, the method (70) comprises (82) deactivating the vertical air piston 40, and (83) moving the dial head 20 up with the dial shaft spring 23 immediately after the top course of the hosiery article cuff is knit. After moving the dial head 20 to the up position 16, the next step of method (70) is (84) rotating the dial a predetermined number of revolutions of the knitting cylinder. In this manner, method (70) of the present invention accomplishes the removal of wrinkles from the hosiery article being knit.

In this embodiment, method (70) then includes (85) activating the vertical air piston 40 to move the dial head 20 to the down knitting position 15, followed by (86) rotating the dial 21 a predetermined number of revolutions of the knitting cylinder. To lock the dial head 20 in the down knitting position 15 before beginning another knitting cycle, the method (70) further comprises (87) deactivating the horizontal air piston 30, and moving the dial shaft latch 26 into engagement with the dial shaft 22 with the horizontal air piston spring 33.

Embodiments of the present invention include a substantially wrinkle-free hosiery article made with a system and/or a method of the present invention. As shown in the embodiment of the present invention in FIG. 5, a hosiery article 100 can be stretched upward at the top 104 of cuff 101 to produce a dewrinkled 103 cuff 101, and a substantially wrinkle-free hosiery article 100. One embodiment of such a substantially wrinkle-free hosiery article comprises manufacturing the hosiery article with a programmable system for dewrinkling a hosiery article in a circular knitting machine, comprising a dial head movable between a down position and an up position, a means for moving the dial head downward and upward, and a dial head locking mechanism for locking and unlocking the dial head, wherein when the dial head is unlocked and moved to the up position, wrinkles are removed from the hosiery article.

Another embodiment of such a substantially wrinkle-free hosiery article comprises manufacturing the hosiery article with a programmable system for dewrinkling a hosiery article in a circular knitting machine, comprising a dial head connected to a dial shaft and movable between a down position and an up position, a means for moving the dial head downward and upward, a dial shaft latch engagable with the dial shaft, a dial shaft engagement mechanism for engaging and disengaging the dial shaft latch with the dial shaft, and a means for applying suction to the hosiery article. When suction is applied to the hosiery article, the dial shaft engagement mechanism disengages the dial shaft latch from the dial shaft, and the means for moving the dial head moves the dial head to the up position, wrinkles are removed from the hosiery article.

Another embodiment of such a substantially wrinkle-free hosiery article comprises manufacturing the hosiery article with a method for dewrinkling a hosiery article in a circular knitting machine having a dial head movable between a down position and an up position, a means for moving the dial head downward and upward, and a dial head locking mechanism for locking and unlocking the dial head. The method comprises unlocking the dial head and moving the dial head to the up position to stretch the hosiery article such that wrinkles are removed from the hosiery article.

Another embodiment of such a substantially wrinkle-free hosiery article comprises manufacturing the hosiery article with a method for dewrinkling a hosiery article in a circular knitting machine having a dial head connected to a dial shaft and movable between a down position and an up position, a means for moving the dial head downward and upward, a dial shaft latch engagable with the dial shaft, a dial shaft engagement mechanism for engaging and disengaging the dial shaft latch with the dial shaft, and a means for applying suction to the hosiery article. The method comprises applying suction to the hosiery article, disengaging the dial shaft latch from the dial shaft, and moving the dial head to the up position to stretch the hosiery article, wherein wrinkles are removed from the hosiery article.

In embodiments of such a substantially wrinkle-free hosiery article comprising manufacturing the hosiery article with a programmable system and/or method for dewrinkling a hosiery article, the dial head up position comprises a predetermined distance ranging from one-fourth inch to one inch from the dial head down position.

Embodiments of the present invention can be applied to any stage of a knitting cycle by adjusting programming for actuation of the means for moving the dial head downward and upward and the dial shaft engagement mechanism at particular times. A hosiery dewrinkling system and method of the present invention is particularly useful for application during knitting of a hosiery article cuff.

The present invention is useful with single cylinder and dual cylinder circular knitting machines. In addition, a dewrinkling system and method of the present invention has utility with other textile manufacturing machines, processes, and articles of manufacture.

Although the present invention has been described with reference to particular embodiments, it should be recognized that these embodiments are merely illustrative of the principles of the present invention. Those of ordinary skill in the art will appreciate that a hosiery dewrinkling system and method of the present invention may be constructed and implemented in other ways and embodiments. For example, embodiments described herein refer to dewrinkling hosiery articles knit from the top down. However, the present invention includes a system and method for dewrinkling hosiery articles made from the bottom up. Accordingly, the description herein should not be read as limiting the present invention, as other embodiments also fall within the scope of the present invention.

What is claimed is:

1. A programmable system for dewrinkling a hosiery article in a circular knitting machine, comprising:

a dial head movable between a down position and an up position;

a means for moving the dial head downward and upward; and a dial head locking mechanism for locking and unlocking the dial head;

wherein when the dial head is unlocked and moved to the up position, wrinkles are removed from the hosiery article.

2. The system of claim 1, wherein the means for moving the dial head downward and upward comprises a vertical air piston.

3. The system of claim 1, wherein the dial head locking mechanism comprises a horizontal air piston.

4. The system of claim 1, wherein the means for moving the dial head downward and upward and the dial head locking mechanism are each programmable for automatic actuation at predetermined times during a knitting cycle.

5. The system of claim 4, the hosiery article comprising a cuff having a top course, wherein the means for moving the dial head downward and upward is programmed to move the dial head to the up position immediately after the top course of the cuff is knit.

6. The system of claim 1, wherein the dial head up position comprises a predetermined distance from the dial head down position.

7. The system of claim 6, wherein the predetermined distance of the dial head up position from the dial head down position comprises the range of one-fourth inch to one inch.

8. The system of claim 7, wherein the predetermined distance of the dial head up position from the dial head down position is three-fourths inch.

9. The system of claim 1, further comprising a means for applying suction to the hosiery article.

10. The system of claim 1, wherein the hosiery article comprises a thick cuff.

11. The system of claim 1, wherein the hosiery article comprises a quarter sock.

12. A programmable system for dewrinkling a hosiery article in a circular knitting machine, comprising:

a dial head connected to a dial shaft and movable between a down position and an up position;

a means for moving the dial head downward and upward;

a dial shaft latch engagable with the dial shaft;

a dial shaft engagement mechanism for engaging and disengaging the dial shaft latch with the dial shaft; and a means for applying suction to the hosiery article, wherein when suction is applied to the hosiery article, the dial shaft engagement mechanism disengages the dial shaft latch from the dial shaft, and the means for moving the dial head moves the dial head to the up position, wrinkles are removed from the hosiery article.

13. The system of claim 12, wherein the means for moving the dial head downward and upward comprises a vertical air piston for moving the dial head to the down position.

14. The system of claim 13, wherein the means for moving the dial head downward and upward further comprises a dial shaft spring surrounding the dial shaft for moving the dial head to the up position.

15. The system of claim 14, the vertical air piston comprising a movable vertical air piston rod, the system further comprising a piston connecting member fastened to the dial head and slidably connected to the vertical air piston rod, wherein when the vertical air piston moves downward a certain distance, the dial head moves downward a corresponding distance.

16. The system of claim 15, further comprising a means for adjusting a range of movement of the piston connecting member in relation to the vertical air piston rod.

17. The system of claim 16, wherein the means for adjusting a range of movement of the piston connecting member in relation to the vertical air piston rod comprises a fastener fixed to the vertical piston rod above the piston connecting member and an adjustment fastener adjustably fixed to the vertical piston rod below the piston connecting member.

18. The system of claim 12, wherein the dial shaft engagement mechanism comprises a horizontal air piston operably connected to the dial shaft latch for moving the dial shaft latch out of engagement with the dial shaft.

19. The system of claim 18, the horizontal air piston having a movable horizontal air piston rod connected to the dial shaft latch, the dial shaft engagement mechanism further comprising a horizontal air piston spring surrounding the horizontal air piston rod for moving the dial shaft latch into engagement with the dial shaft.

20. The system of claim 19, wherein the dial shaft is mounted in a dial shaft housing having a dial head shelf extending perpendicularly from the dial shaft housing at a level for supporting the dial head in the down position and wherein the horizontal air piston rod is positioned on one side of the dial head shelf, further comprising a pivot means attached to the side of the dial head shelf opposite the horizontal air piston rod and a latch slide having two spaced apart members mounted to the top of the dial head shelf, wherein the dial shaft latch is pivotably attached to the pivot means and slidably positioned between the two spaced apart members of the latch slide.

21. The system of claim 12, wherein the means for moving the dial head downward and upward and the dial shaft engagement mechanism are each programmable for automatic actuation at predetermined times during a knitting cycle.

22. The system of claim 21, the hosiery article comprising a cuff having a top course, wherein the means for moving the dial head downward and upward is programmed to move the dial head to the up position immediately after the top course of the cuff is knit.

23. The system of claim 12, wherein the dial head up position comprises a predetermined distance from the dial head down position.

24. The system of claim 23, wherein the predetermined distance of the dial head up position from the dial head down position comprises the range of one-fourth inch to one inch.

25. The system of claim 24, wherein the predetermined distance of the dial head up position from the dial head down position is three-fourths inch.

26. The system of claim 12, wherein the means for moving the dial head downward and upward comprises a vertical air piston and the dial shaft engagement mechanism comprises a horizontal air piston and each air piston is connected to a source of compressed air by a separate air tube, further comprising an electrovalve for each air piston connected to the source of compressed air, wherein each electrovalve is programmable to turn on and off a flow of compressed air to the respective air piston at predetermined times during a knitting cycle.

27. The system of claim 26, further comprising an air flow adjustment valve connected to each air tube for buffering the flow of compressed into the air piston connected to the air tube.

28. The system of claim 12, wherein the means for applying suction to the hosiery article comprises a pneumatic hosiery transportation system.

29. The system of claim 12, wherein the hosiery article comprises a thick cuff.

30. The system of claim 12, wherein the hosiery article comprises a quarter sock.

31. A programmable system for dewrinkling a hosiery article in a circular knitting machine, comprising:

a dial head connected to a dial shaft and movable between a down position and an up position;

a vertical air piston connected to a movable vertical air piston rod for moving the dial head to the down position;

a dial shaft spring surrounding the dial shaft for moving the dial head to the up position;

a dial shaft latch engagable with the dial shaft;

a horizontal air piston having a movable horizontal air piston rod connected to the dial shaft latch for moving the dial shaft latch out of engagement with the dial shaft;

a horizontal air piston spring surrounding the horizontal air piston rod for moving the dial shaft latch into engagement with the dial shaft;

a piston connecting member fastened to the dial head and slidably connected to the vertical air piston rod, wherein when the vertical air piston moves downward a certain distance, the dial head moves downward a corresponding distance;

a means for adjusting a range of movement of the piston connecting member in relation to the vertical air piston rod; and a means for applying suction to the hosiery article, wherein the vertical air piston and the horizontal air piston are each programmable for automatic actuation at predetermined times during a knitting cycle;

wherein the dial head up position comprises a predetermined distance from the dial head down position in the range of one-fourth inch to one inch;

wherein when suction is applied to the hosiery article, the horizontal air piston disengages the dial shaft latch from the dial shaft, and the dial shaft spring moves the dial head to the up position, wrinkles are removed from the hosiery article.

32. The system of claim 31, further comprising a source of compressed air connected by a first air tube to the vertical air piston and connected by a second air tube to the horizontal air piston and an electrovalve connected to each of the first and second air tubes, wherein each electrovalve is programmable to turn on and off a flow of compressed air to the respective air piston at predetermined times during the knitting cycle.

33. The system of claim 32, further comprising an air flow adjustment valve connected to each air tube for buffering the flow of compressed into the air piston connected to the air tube.

34. A method for dewrinkling a hosiery article in a circular knitting machine having a dial head movable between a down position and an up position, a means for moving the dial head downward and upward, and a dial head locking mechanism for locking and unlocking the dial head, the method comprising:

unlocking the dial head;

moving the dial head to the up position to stretch the hosiery article, wherein wrinkles are removed from the hosiery article.

35. The method of claim 34, further comprising programming the means for moving the dial head downward and upward and the dial head locking mechanism for automatic actuation at predetermined times during a knitting cycle.

36. The method of claim 35, the hosiery article comprising a cuff having a top course, further comprising programming the means for moving the dial head downward and upward to move the dial head to the up position immediately after the top course of the cuff is knit.

37. The method of claim 34, wherein the dial head up position comprises a predetermined distance from the dial head down position.

38. The method of claim 37, wherein the predetermined distance of the dial head up position from the dial head down position comprises the range of one-fourth inch to one inch.

39. The method of claim 38, wherein the predetermined distance of the dial head up position from the dial head down position is three-fourths inch.

40. The method of claim 34, wherein the means for moving the dial head downward and upward comprises a vertical air piston.

41. The method of claim 34, wherein the dial head locking mechanism comprises a horizontal air piston.

42. The method of claim 34, further comprising applying suction to the hosiery article.

43. The method of claim 34, wherein the hosiery article comprises a thick cuff.

44. The method of claim 34, wherein the hosiery article comprises a quarter sock.

45. A method for dewrinkling a hosiery article in a circular knitting machine having a dial head connected to a dial shaft and movable between a down position and an up position, a means for moving the dial head downward and upward, a dial shaft latch engagable with the dial shaft, a dial shaft engagement mechanism for engaging and disengaging the dial shaft latch with the dial shaft, and a means for applying suction to the hosiery article, the method comprising:

applying suction to the hosiery article;

disengaging the dial shaft latch from the dial shaft; and moving the dial head to the up position to stretch the hosiery article, wherein wrinkles are removed from the hosiery article.

46. The method of claim 45, further comprising programming the means for moving the dial head downward and upward and the dial shaft engagement mechanism for automatic actuation at predetermined times during a knitting cycle.

47. The method of claim 46, the hosiery article comprising a cuff having a top course, further comprising programming the means for moving the dial head downward and upward to move the dial head to the up position immediately after the top course of the cuff is knit.

48. The method of claim 45, wherein the dial head up position comprises a predetermined distance from the dial head down position.

49. The method of claim 48, wherein the predetermined distance of the dial head up position from the dial head down position comprises the range of one-fourth inch to one inch.

50. The method of claim 49, wherein the predetermined distance of the dial head up position from the dial head down position is three-fourths inch.

51. The method of claim 45, wherein the means for moving the dial head downward and upward comprises a vertical air piston for moving the dial head to the down position.

52. The method of claim 51, wherein the means for moving the dial head downward and upward further comprises a dial shaft spring surrounding the dial shaft for moving the dial head to the up position.

53. The method of claim 51, wherein the vertical air piston comprises a movable vertical air piston rod, wherein a piston connecting member is fastened to the dial head and slidably connected to the vertical air piston rod, further comprising moving the vertical air piston downward a certain distance, wherein the dial head moves downward a corresponding distance.

54. The method of claim 53, further comprising a means for adjusting a range of movement of the piston connecting member in relation to the vertical air piston rod.

55. The method of claim 54, wherein the means for adjusting a range of movement of the piston connecting member in relation to the vertical air piston rod comprises a fastener fixed to the vertical piston rod above the piston connecting member and an adjustment fastener adjustably fixed to the vertical piston rod below the piston connecting member.

56. The method of claim 45, wherein the dial shaft engagement mechanism comprises a horizontal air piston operably connected to the dial shaft latch for moving the dial shaft latch out of engagement with the dial shaft.

57. The method of claim 56, the horizontal air piston having a movable horizontal air piston rod connected to the dial shaft latch, the dial shaft engagement mechanism further comprising a horizontal air piston spring surrounding the horizontal air piston rod, the method further comprising moving the horizontal air piston spring away from the horizontal air piston to move the dial shaft latch into engagement with the dial shaft.

58. The method of claim 57, wherein the dial shaft is mounted in a dial shaft housing having a dial head shelf extending perpendicularly from the dial shaft housing at a level for supporting the dial head in the down position, wherein the horizontal air piston rod is positioned on one side of the dial head shelf, wherein a pivot means is attached to the side of the dial head shelf opposite the horizontal air piston rod, wherein a latch slide having two spaced apart members is mounted to the top of the dial head shelf, and wherein the dial shaft latch is pivotably attached to the pivot means and slidably positioned between the two spaced apart members of the latch slide.

59. The method of claim 45, wherein the means for moving the dial head downward and upward comprises a vertical air piston and the dial shaft engagement mechanism comprises a horizontal air piston, wherein each air piston is connected to a source of compressed air by a separate air tube, and wherein an electrovalve for each air piston is connected to the source of compressed air, the method further comprising programming each electrovalve to turn on and off a flow of compressed air to the respective air piston at predetermined times during a knitting cycle.

60. The method of claim 59, wherein an air flow adjustment valve is connected to each air tube for buffering the flow of compressed into the air piston connected to the air tube.

61. The method of claim 45, wherein the hosiery article comprises a thick cuff.

62. The method of claim 45, wherein the hosiery article comprises a quarter sock.

63. The method of claim 45, wherein the dial head comprises a dial, further comprising programming the dial to rotate a predetermined number of revolutions of the knitting cylinder before disengaging the dial shaft latch from the dial shaft.

64. The method of claim 63, wherein the predetermined number of dial revolutions before disengaging the dial shaft latch from the dial shaft comprises 10 to 20 revolutions.

65. The method of claim 45, wherein the dial head comprises a dial, further comprising programming the dial to rotate a predetermined number of revolutions of the knitting cylinder after disengaging the dial shaft latch from the dial shaft.

66. The method of claim 65, wherein the predetermined number of dial revolutions after disengaging the dial shaft latch from the dial shaft comprises 2 to 10 revolutions.

67. The method of claim 45, wherein the dial head comprises a dial, further comprising programming the dial to rotate a predetermined number of revolutions of the knitting cylinder after moving the dial head to the up position.

68. The method of claim 67, wherein the predetermined number of dial revolutions after moving the dial head to the up position comprises 8 to 10 revolutions.

69. The method of claim 45, wherein the dial head comprises a dial, further comprising moving the dial head to the down position and programming the dial to rotate a predetermined number of revolutions of the knitting cylinder after moving the dial head to the down position.

70. The method of claim 69, wherein the predetermined number of dial revolutions after moving the dial head to the down position comprises 2 to 4 revolutions.

71. A hosiery article made with the system of claim 7.

72. A hosiery article made with the system of claim 24.

73. A hosiery article made with by the method of claim 38.

74. A hosiery article made with by the method of claim 49.

* * * * *